US005085333A

United States Patent [19]

Dutt et al.

[11] Patent Number: 5,085,333

[45] Date of Patent: Feb. 4, 1992

[54] TAMPER EVIDENT CONTAINER OVERCAP MOLDED IN STRAIGHT DRAW MOLD

[75] Inventors: Herbert V. Dutt, Venetia, Pa.; Gary L. Mengeu, Wheeling, W. Va.; Stephen F. Royal, Woodridge, Ill.

[73] Assignee: Continental Plastics, Inc., Triadelphia, W. Va.

[21] Appl. No.: 670,006

[22] Filed: Mar. 15, 1991

[51] Int. Cl.[5] ..... B65D 41/32

[52] U.S. Cl. ..... 215/250; 215/256; 215/254; 215/253; 215/258; 220/266; 220/270; 220/276

[58] Field of Search ..... 215/250, 251, 253, 254, 215/255, 256, 258; 220/270, 266, 276

[56] References Cited

U.S. PATENT DOCUMENTS

| | | | |
|---|---|---|---|
| 3,955,716 | 5/1976 | Goncalves | 215/256 X |
| 4,494,663 | 1/1985 | Bertaud et al. | 215/250 X |
| 4,513,889 | 4/1985 | Beard | 215/256 X |
| 4,534,479 | 8/1985 | Conti | 215/258 X |
| 4,721,215 | 1/1988 | Bertaud | 215/253 X |

*Primary Examiner*—Gary E. Elkins
*Assistant Examiner*—Paul A. Schwarz
*Attorney, Agent, or Firm*—Richard V. Westerhoff

[57] ABSTRACT

A tamper evident overcap has a tear band which is offset radially from both a ring member sonically welded to a container shoulder and a cap, by generally radially extending frangible bridges. The bridges are severed by applying force to a pull tab extending radially and axially from the tear band in alignment with a gap in the ring member so that there are no undercut faces on the overcap which can consequently be molded in a straight draw mold without cams or slides.

17 Claims, 3 Drawing Sheets

TAMPER EVIDENT CONTAINER OVERCAP MOLDED IN STRAIGHT DRAW MOLD

BACKGROUND

1. Field of Invention

This invention is directed to an overcap for a container with a closure, and more particularly, it relates to a tamper evident overcap which can be integrally molded in a straight draw mold without the need for cams or slides.

2. Background of the Invention

For some containers such as for example containers having a closure with a dispenser for dispensing the contents of the container, it is desirable to have an overcap to protect the dispenser during shipment and until first use.

There is also a demand today for tamper evident containers which provide an indication that the container has been opened or tampered with. Many tamper evident closures include a tear band which connects the removable portion of the closure to a portion secured to or otherwise engaged by the container. In order to open the container, the tear band is first pulled loose. The tear band cannot be replaced so that when the closure is reapplied to the container, the absence of the tear band provides a visual indication that the container has been opened. The tear band is usually defined by score lines along which the tear band separates from the remainder of the container, or by discrete frangible bridges or ribs extending across a gap between the tear band and the remainder of the closure. Typically, these score lines extend radially into, or the bridges extend in, the common plane of the tear band and the adjacent portion of the closure. This produces undercuts which must be formed by slides or cams in the mold in which the closure is formed. In some cases, the score lines are formed by a separate operation after the closure is removed from the mold.

There are tamper evident overcaps which are fixed to a container such as by sonic welding or adhesives. Typically, these overcaps have score lines which extend down and around the side walls of the overcap and even, in some cases, up over the end wall. The overcap is torn loose along the score lines by pulling on a tab. These score lines also require either slides or cams during molding or a post-molding operation.

There remains a need, therefore, for an improved overcap.

There is more particularly a need for an overcap which is tamper evident yet can be molded in a straight draw mold without slides or cams.

There is also a need for such an overcap which can be reused after it has been initially removed.

SUMMARY OF THE INVENTION

These and other needs are satisfied by the invention, which is directed to a tamper evident container overcap which includes a tear band offset laterally from both an axially extending flange on a ring member secured to a shoulder on the container, preferably by sonic welding, and the skirt on a cap. The tear band is connected to the cap skirt and axially extending flange on the ring member by generally laterally extending tearable connections which preferably are circumferentially spaced frangible ribs, but could also be scored membranes.

A pull tab integrally molded with the tear band is aligned such that it forms no undercut surfaces in the overcap. Preferably, the pull tab extends laterally and axially from the tear band and is aligned with a gap in the ring member to eliminate undercut surfaces. The pull tab could alternatively extend axially from the tear band.

Preferably, there is also a gap in the tear band adjacent the pull tab and aligned with the gap in the ring member. In addition, in the preferred embodiment of the invention, there is no tearable connection between the tear band and the cap skirt at the gap in the ring member.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
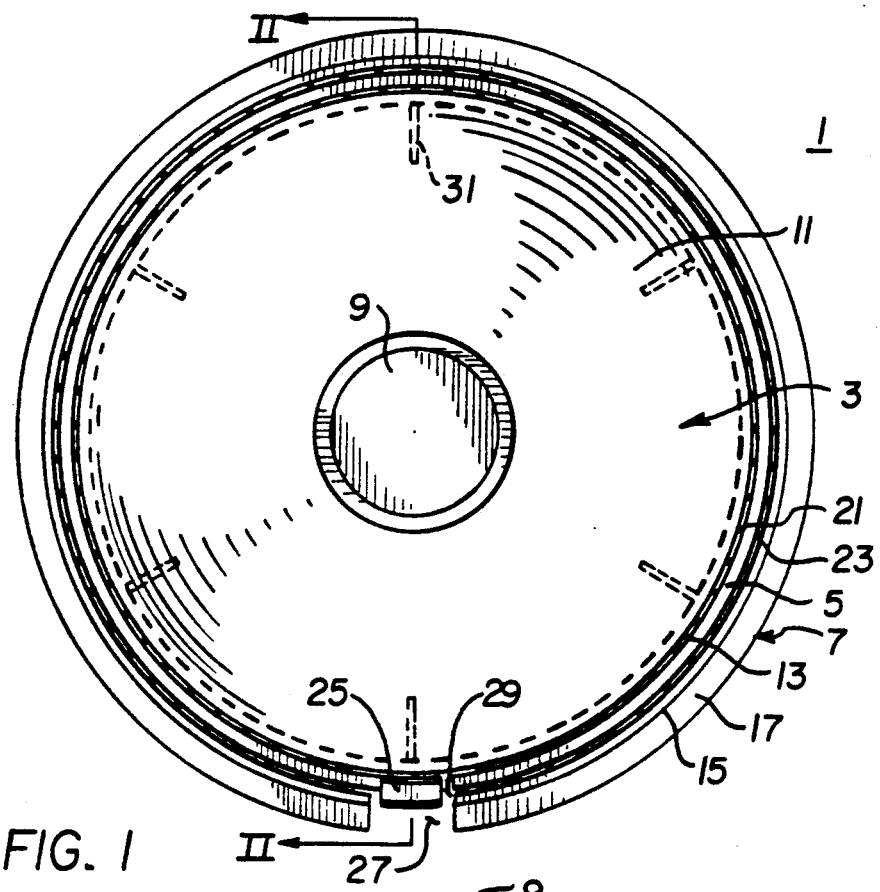
FIG. 1 is a top plan view of an overcap in accordance with the invention.
Figure 2:
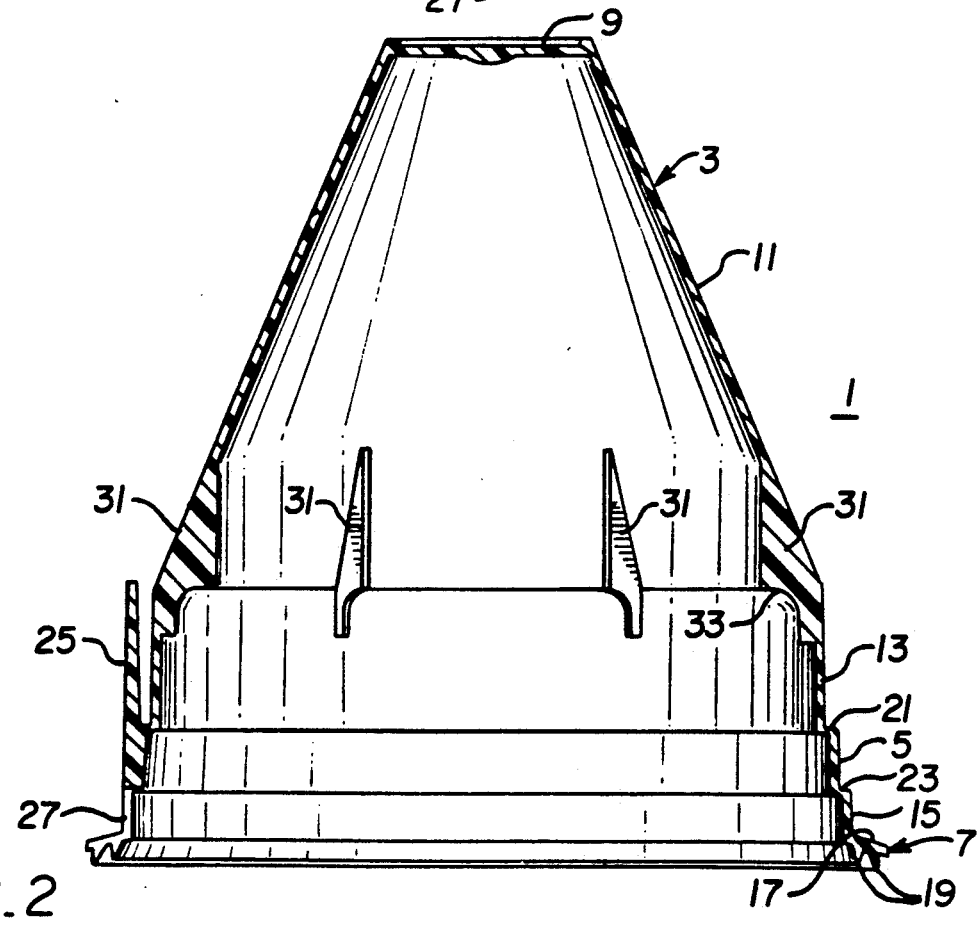
FIG. 2 is a vertical sectional view through the overcap of FIG. 1 taken along the line II—II.
Figure 3:
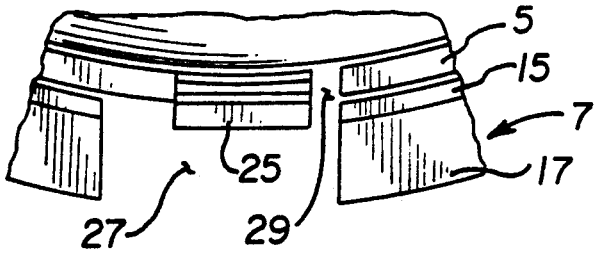
FIG. 3 is a fragmentary view in enlarged scale of a section of FIG. 1.

The overcap 1 of the invention includes a cap 3, a tear band 5 and a ring member 7 which in the exemplary embodiment are circular although they need not be. The cap 3 includes an end wall 9, a frusto conical section 11 and a cylindrical skirt 13. The ring member 7 includes an axially extending flange 15 and a generally laterally or radially outwardly extending flange 17. The flange 17 may also extend axially as well as radially to match the slope of a shoulder on a container as will be seen. Axially facing ribs 19 on the underside of the flange 17 serve as energy concentrators for sonically welding the ring member to a container shoulder.

The tear band 5 is greater in diameter than the skirt 13 of the cap 3 but smaller in diameter than the axially extending flange 15 on the ring member 7 so that the tear band is laterally offset from both the cap skirt and the ring member. Tearable connections in the form of a plurality of circumferentially spaced frangible bridges 21 extend generally radially between the cap skirt 13 and the upper end of tear band 5. The lower end of the tear band 5 is connected to the upper end of flange 15 by additional tearable connections in the form of circumferentially spaced frangible bridges 23.

A pull tab 25 is molded to the outer surface of the tear band 5 and extends axially upward to provide a grip for exerting a force on the tear band 5. The pull tab 25 is aligned with a gap 27 in the flanges 15 and 17 of the ring member 7 so that the pull tab 25 does not form any undercut surfaces in the overcap 1. There is also a gap 29 in the tear band at the pull tab to provide a start for tearing the band 5 loose from the ring member 7. The gap 29 in the tear band is aligned with the gap 27 in the ring member.

Integrally molded gusset plates 31 form projections extending radially inward from the inner surface of the cap 3. In the exemplary cap, there are six such gusset plates spaced 60 degrees apart. A radiused notch 33 at the inner corner of each gusset plate forms a horizontal shoulder 35.

Figure 4:
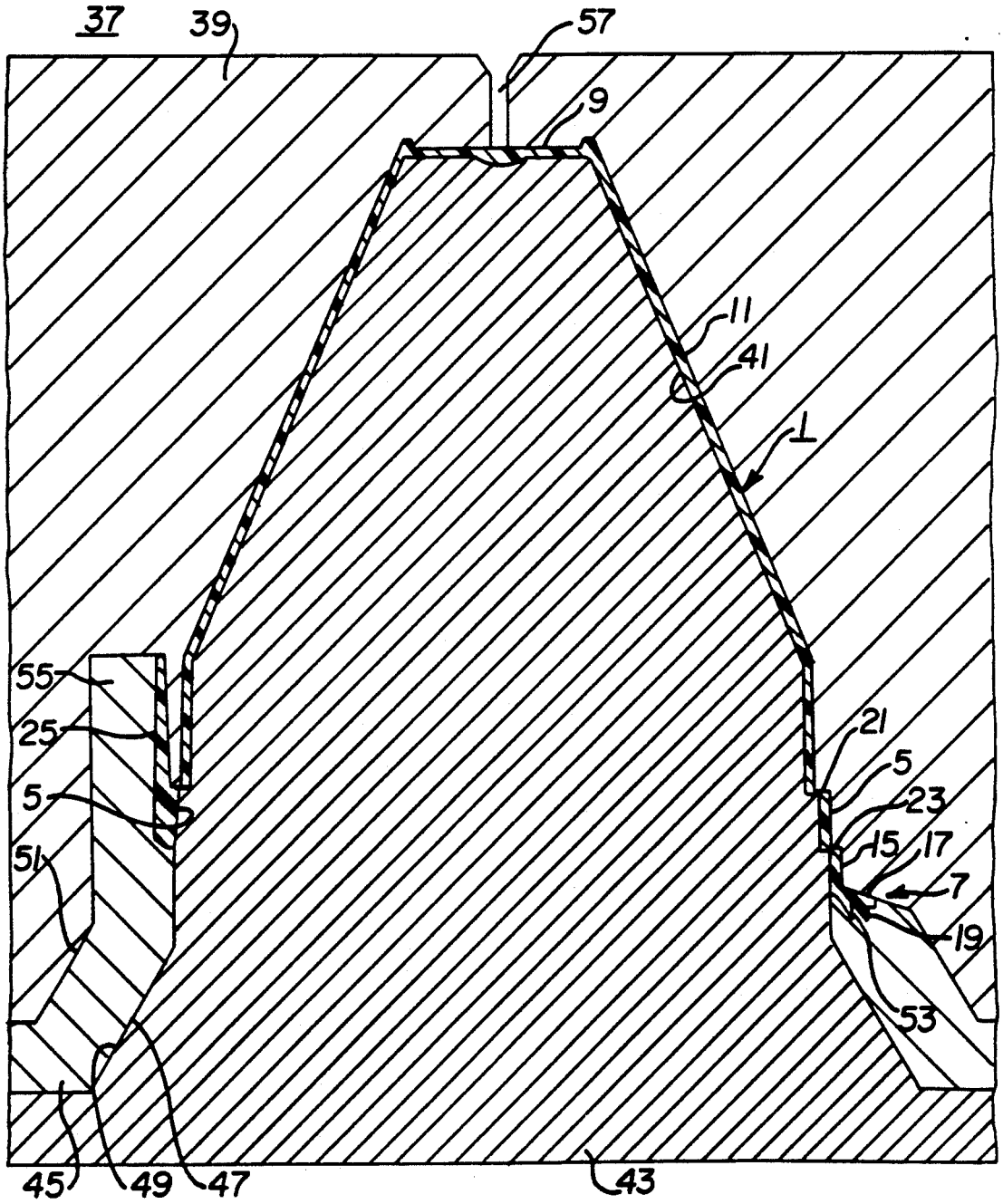
FIG. 4 is a fragmentary view in enlarged scale of a portion of the overcap as shown in FIG. 2 illustrating how the pull tab is formed in the mold without the use of slides or cams.

The overcap 1 is molded in one piece in a straight draw mold 37 without the use of cams or slides. As shown in FIG. 4, the mold 37 includes a female cavity member 39 defining a cavity 41, a male part defined by a core 43 and a stripper ring 45. The core 43 extends into the cavity 41 and is spaced from the wall of the cavity by an amount which defines the end wall 9, the frusto conical section 11, the tear band 5 and the axially extending flange 15 of the ring member 7. The stripper ring 45 has a bevelled internal surface 47 which mates with a bevelled surface 49 of the core 43 and an outer bevelled surface 51 which mates with the cavity member 39. Grooves 53 in the end of the stripper ring define the energy concentrator ribs 19 and the bottom surface of the laterally extending flange 17 on the ring member 7.

As is conventional, this stripper ring 45 is used to strip the molded overcap 1 from the core 43 after the core has been removed from the cavity. The stripper ring 45 has an insert 55 which defines the gap 27 in the ring. This insert 55 also defines the bottom edge of the tear band 5 and the bottom edge and the outer surface of the pull tab 25. As will be noted from FIG. 4, the top edge and inner surface of the pull tab 25 are defined by the female mold part 39. The bridges 21 and 23 are defined by gaps between the cavity member 41 and core member 43 of the mold.

Resin in the plastic state is injected through a gate 57 in the cavity member 39 at the center of the end wall 9 and spreads throughout the mold. When the resin is set, the cavity member 39 is removed and the overcap 1 is separated from the core member 41 by the stripper ring 45. Since there are no undercut surfaces in the overcap 1, no slides or cams are required in the mold 37.

Figure 5:
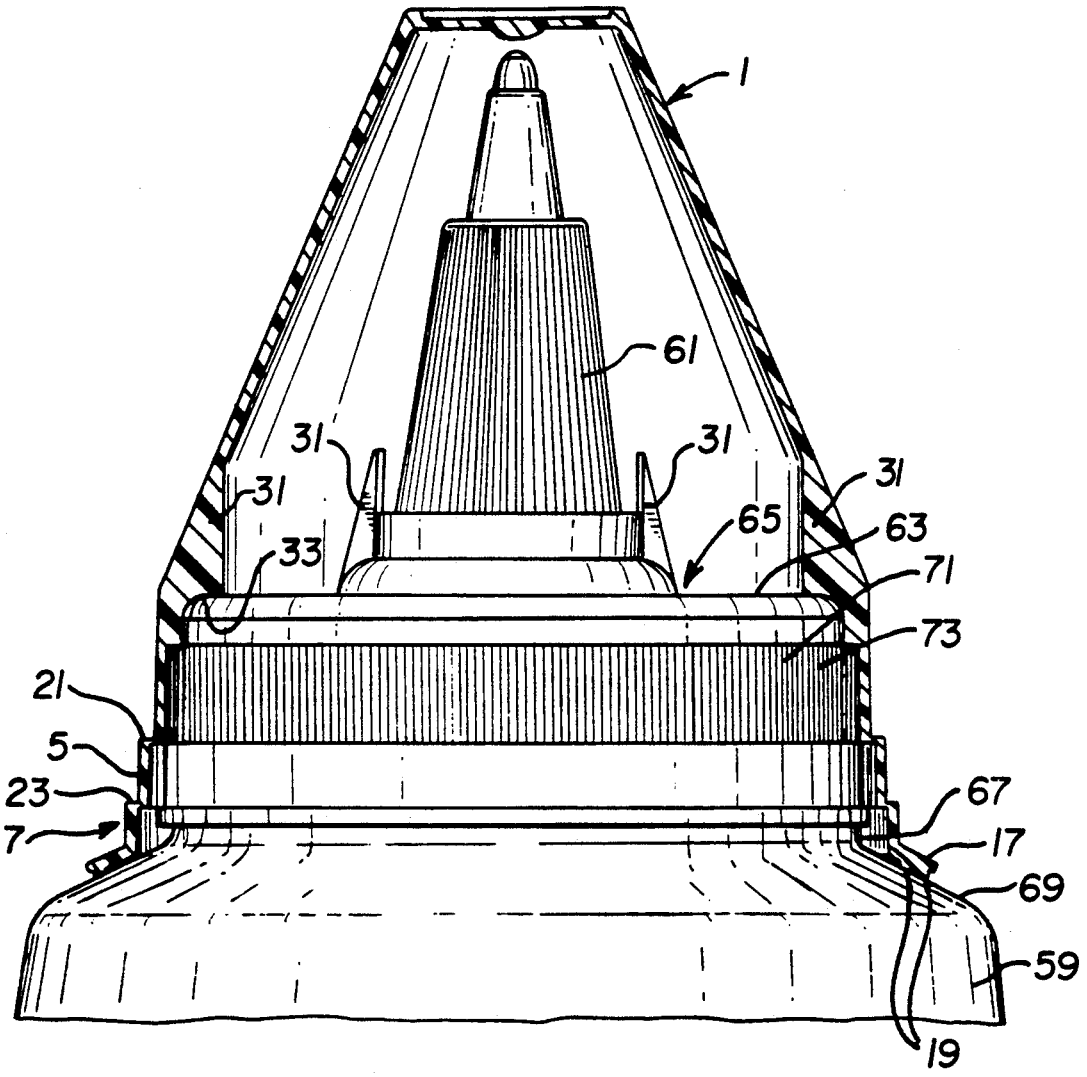
FIG. 5 is a vertical sectional view similar to FIG. 2 showing the overcap of the invention in place on a container.

FIG. 5 illustrates application of the overcap 1 to a container 59 with a twist type dispensing spout 61 extending centrally from the end wall 63 of a closure 65 secured to the neck 67 of the container. The neck 67 is joined to the body of the container by a generally laterally extending shoulder 69. After the container has been filled and the closure applied to the container neck, the overcap 1 is placed over the closure 65 and its dispensing spout 61, and the flange 17 is secured to the shoulder 69 such as by sonic welding. As is known, the ribs 19 concentrate the sonic energy to effect a good permanent bond of the ring member 7 to the container shoulder 69. Alternatively, the flange 17 could be cemented or otherwise secured to the shoulder 69.

With the overcap 1 secured in place over the closure 65, the container 59 cannot be opened without first removing the overcap 1. The shoulders 33 of the gusset plates 31 seat on the closure 65 to prevent any axial forces applied to the overcap 1 from inadvertently rupturing the frangible bridges 21 and 23.

The overcap 1 is removed by grasping the pull tab 25 and pulling to tear the frangible bridges 21 and 23. The twist type spout 61 can then be used to dispense the contents of the container 59. The type of closure 65 used on the container 59 under the overcap 1 is not relevant to the invention. Other types of dispensing closures, and even closures without dispensing openings, such as plain screw or lug closures could be used.

If desired, the overcap 1 can be reapplied to the container over the closure 65; however, the absence of the tear band 5 will indicate that the container 59 has been opened or at least tampered with. In the exemplary overcap, the skirt 13 through the gusset plates 31 fits snugly over the closure 65 to retain the replaced overcap. Vertical serrations 71 in the side wall 73 of the closure 65 help to retain the overcap 1 in place. The shoulders 33 on the gusset plates 31 seat against the end wall 63 of the closure 65 so that the skirt 13 of the overcap remains spaced from the ring member 7 (which is permanently secured to the container 59) by the height of the now missing tear band 5. In the preferred form of the invention, the side wall 73 of the closure 65 is of a color which contrasts with the color of the overcap 1 including the tear band 5 to provide a further visual indication that the overcap has been removed or tampered with.

In alternate configurations of the overcap 1, the pull tab can extend radially outward from the tear band 5 and need not extend axially as in the preferred embodiment. Alternatively, the pull tab 25 could extend only axially and not radially from the tear band.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An overcap for a container having a neck joined to a body portion by a generally laterally extending shoulder, said overcap comprising:

a ring member having an axially extending flange of a first lateral dimension, and a generally laterally extending flange extending laterally outward from said axially extending flange, said generally laterally extending flange being secured to said generally laterally extending shoulder on said container;

a cap member having an axially extending skirt with a second lateral dimension which is smaller than said first lateral dimension;

a tear band having a third lateral dimension which is between said first and second lateral dimensions and having first and second axial edges;

generally laterally extending first tearable connection means connecting said first axial edge of said tear band to said axially extending flange of said ring member;

generally laterally extending second tearable connection means connecting said second axial edge of said tear band to said skirt on said cap member; and a pull tab secured to said tear band for applying a force to said tear band to tear said first and second tearable connection means and separate said cap member from said ring member which remains secured to said container shoulder, said pull tab being aligned such that it forms no undercuts.

2. The overcap of claim 1 wherein said first and second tearable connection means comprise generally laterally extending circumferentially spaced frangible ribs.

3. The overcap of claim 1 wherein said pull tab extends laterally outward and axially from said tear band, and said axially and laterally extending flanges of said ring member have gaps therein axially aligned with said pull tab.

4. The overcap of claim 1 wherein said pull tab extends at least laterally outward from said tear band, and said axially and laterally extending flanges of said ring member have gaps therein axially aligned with said pull tab.

5. The overcap of claim 4 wherein said tear band has a gap therethrough adjacent said pull tab and aligned with said gaps in the axially and laterally extending flanges in said ring member.

6. The overcap of claim 5 wherein said first and second tearable connections comprise generally laterally extending circumferentially spaced frangible ribs.

7. The overcap of claim 6 wherein no frangible bridges are provided between the tear band and the skirt of said cap at said gaps in the axially and laterally extending flanges of said ring member.

8. The overcap of claim 1 wherein said cap has inward projections forming cap stops.

9. In combination:

a container having a neck joined to a body portion by a laterally extending shoulder;

a closure applied to the neck of said container; and an overcap comprising:

a ring member having an axially extending flange of a first lateral dimension, and a generally laterally extending flange extending laterally outward from said axially extending flange, said generally laterally extending flange being secured to said generally laterally extending shoulder on said container, said ring member having an axially extending gap through said flanges;

a cap member having an axially extending skirt with a second lateral dimension which is smaller than said first lateral dimension;

a tear band having a third lateral dimension which is between said first and second lateral dimensions and having first and second axial edges;

generally laterally extending first tearable connection means connecting said first axial edge of said tear band to said axially extending flange of said ring member;

generally laterally extending second tearable connection means connecting said second axial edge of said tear band to said skirt on said cap member to secure said cap over said closure; and a pull tab secured to and extending laterally and axially from said tear band and axially aligned with said gap in the flanges of said ring member for applying a force to said tear band to tear said first and second tearable connection means and separate said cap member from said ring member which remains secured to said container shoulder.

10. The combination of claim 9 wherein said first and second connecting means comprise generally laterally extending, circumferentially spaced bridges.

11. The combination of claim 10 wherein said tear band has a gap therein aligned with the gap in the flanges of said ring member.

12. The combination of claim 10 wherein no frangible bridges are provided between said tear band and said skirt adjacent said pull tab.

13. The combination of claim 9 wherein said closure has a sidewall, an end wall, and a dispensing spout extending axially from said end wall, and wherein said skirt of said cap of said overcap snugly engages said sidewall of said closure to removably secure said cap over said closure after said tear band has been removed.

14. The combination of claim 13 including inward projections on said cap which seat against the end wall of said closure to preclude rupture of said first and second connection means through application of a force to said cap.

15. The combination of claim 14 wherein said tearband has an axially extending gap therethrough adjacent said pull tab and aligned with the gap through the flanges in said ring member.

16. The combination of claim 15 wherein no frangible bridges are provided between said tearband and said skirt at said pull tab.

17. The combination of claim 9 wherein said closure has a sidewall and an end wall and including inward projections on said cap which seat against the end wall of said closure to preclude rupture of said first and second connection means through application of force to said cap.

* * * * *